US005094252A

United States Patent [19]

Stumpf

[11] Patent Number: 5,094,252

[45] Date of Patent: Mar. 10, 1992

[54] DEVICE FOR THE PREVENTION OF COLLATERAL FIBULAR LIGAMENT INJURIES

[76] Inventor: Jürgen Stumpf, Bahnhofstrasse 23, Fulda, Fed. Rep. of Germany, D-6400

[21] Appl. No.: 669,480

[22] Filed: Mar. 14, 1991

[30] Foreign Application Priority Data

Apr. 12, 1990 [DE] Fed. Rep. of Germany ..... 4011888

[51] Int. Cl.[5] ..... A61F 5/37

[52] U.S. Cl. ..... 128/882; 128/DIG. 20

[58] Field of Search ..... 128/882, 77, 87 R, 89 R, 128/90, DIG. 20, 24 R, 25 B; 5/455; 36/3 A, 88, 89, 93

[56] References Cited

U.S. PATENT DOCUMENTS

| | | | |
|---|---|---|---|
| 1,230,290 | 6/1917 | Geiger | 441/93 |
| 3,046,576 | 7/1962 | Bernhardt | 441/92 |
| 3,888,242 | 6/1975 | Harris | 36/88 |
| 4,215,679 | 8/1980 | Rustin | 128/DIG. 20 |
| 4,256,094 | 3/1981 | Kapp | 128/24 R |
| 4,413,620 | 11/1983 | Tucker | 128/24 R |
| 4,502,470 | 3/1985 | Kiser | 128/DIG. 20 |
| 4,610,253 | 9/1986 | Rosenberg | 128/882 |
| 4,730,610 | 3/1988 | Graebe | 128/882 |
| 4,793,328 | 12/1988 | Kolstedt | 128/DIG. 20 |
| 4,999,932 | 3/1991 | Grim | 36/88 |

FOREIGN PATENT DOCUMENTS 8802338 8/1989 Fed. Rep. of Germany .

*Primary Examiner*—Robert A. Hafer
*Assistant Examiner*—Michael Brown
*Attorney, Agent, or Firm*—Wegner, Cantor, Mueller & Player

[57] ABSTRACT

In the upper (1) of a shoe, pressure chambers (3, 4, 5) are provided which can be inflated by a gas bottle (6) when an extension sensor (7) signals the risk of a twisting or spraining of the foot. The inflation of the pressure chambers (3, 4, 5) takes place so rapidly that a collateral fibular ligament injury is precluded.

3 Claims, 2 Drawing Sheets

DEVICE FOR THE PREVENTION OF COLLATERAL FIBULAR LIGAMENT INJURIES

BACKGROUND OF THE INVENTION

The invention refers to a device for the prevention of collateral fibular ligament injuries by way of movement restrictors that prevent twisting or spraining of the foot.

Collateral fibular ligament injuries represent a very common sports injury. They result from hyperextension of the collateral fibular ligaments due to a twisting or spraining of the foot. The risk of such injuries can be reduced by a high, firm shoe structure, as for example is the general practice in hiking. Often athletes use relatively rigid bandages to give the foot greater support.

A drawback of all known measures to reduce the risk of collateral fibular ligament injuries is that the measures greatly restrict the mobility of the foot and thus, although they protect, they also represent an impediment to sports performance.

SUMMARY OF THE INVENTION

The invention is directed to a device which prevents collateral fibular ligament injuries while not restricting the normal mobility of the foot but projecting the foot as reliably as possible against twisting or spraining.

The object is accomplished according to the invention by providing movement restrictors having inflatable pressure chambers, and an accumulator automatically triggered by an extension sensor to inflate the pressure chambers.

Such a device operates according to a principle comparable to that of an air bag in a motor vehicle. As long as there is no risk of twisting or spraining of the foot, the pressure chambers remain uninflated, so that the freedom of movement of the foot is not undesirably restricted. If a critical extension of the collateral fibular ligaments occurs, the pressure chambers inflate and prevent further extension of the foot, so that a collateral fibular ligament injury is prevented. After inflation of the pressure chambers, the desired freedom of movement can be restored by releasing the gas in the pressure chambers.

The device is configured in a particularly simple manner when the accumulator is a pressurized gas bottle and the extension sensor is a mechanism that opens a pressure-medium connection from the gas bottle to the pressure chambers in the event of hyperextension. Such gas bottles are in common use in air bags or life preservers. The extension sensor may, for example, be configured such that it breaks upon hyperextension and thus opens the connection from the gas bottle to the pressure chamber. However, it is also possible to use an electronic component as an extension sensor which, at a critical extension, generates an electrical signal by which a solenoid valve is actuated.

The device is particularly effective if the pressure chambers are provided in the upper of a shoe and extend to a point before the sole or all the way into the sole. The necessary gas bottle can be accommodated without difficulty if it is disposed in the sole of the shoe.

It is also advantageous if the pressure chambers are provided in a stocking-like bandage. Such a bandage makes it possible to configure the device independently of the shoes. Thus, one does not need to buy new shoes when one wants to make use of the invention. It is also possible to use such bandages independently of the shoes being worn in a given case.

BRIEF DESCRIPTION OF THE DRAWINGS

The invention permits numerous configurations. To clarify its basic principle further, one of these is shown schematically in the drawing and is described below. In the drawing.

DETAILED DESCRIPTION OF THE PREFERRED EMBODIMENTS

Figure 1:
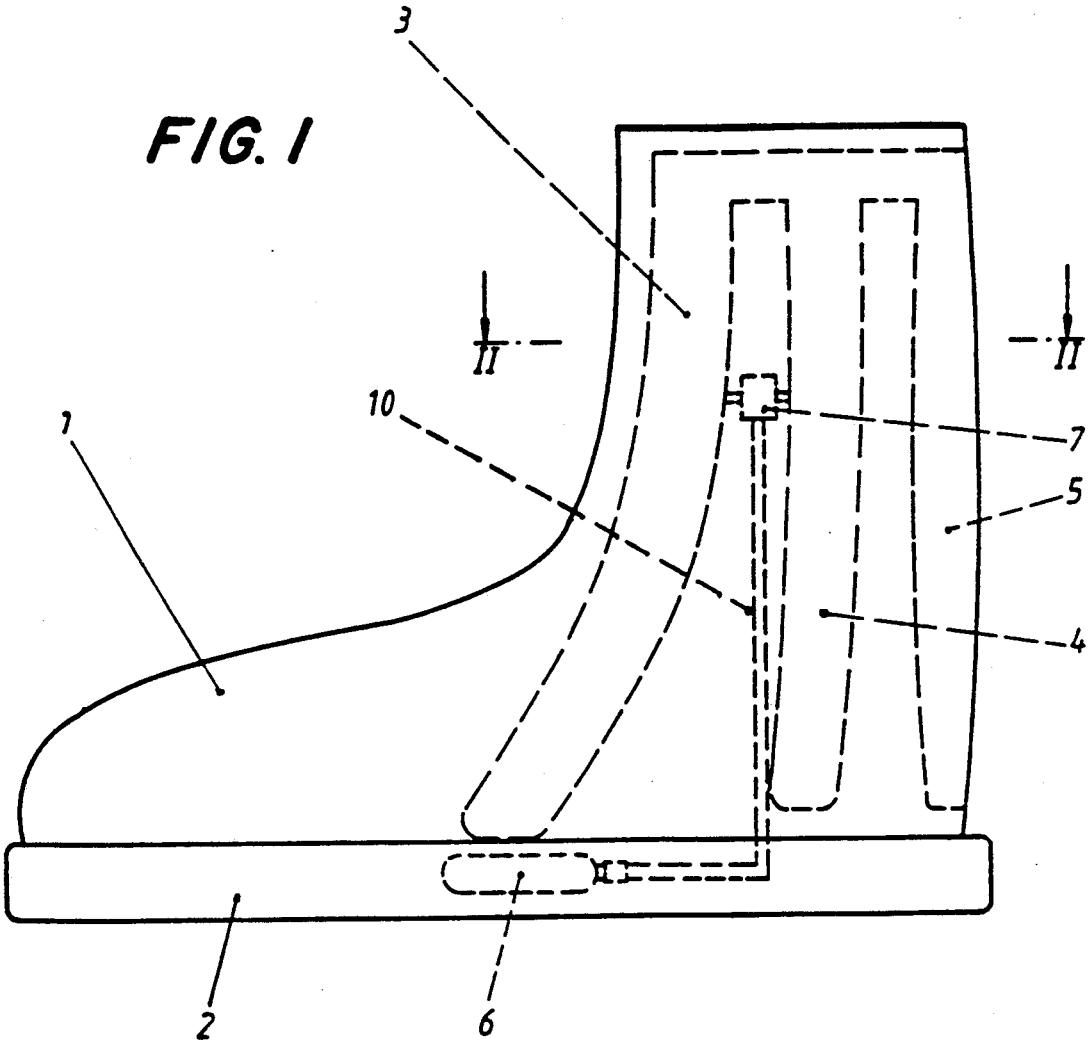
FIG. 1 shows aside view of a shoe designed according to the invention.

FIG. 1 shows a shoe including a high upper 1 and a sole 2. Pressure chambers 3, 4, 5 are disposed laterally in the shoe 1, and shown in dashed lines, which chambers are not pressurized during normal use of the shoe.

The pressure chambers 3, 4 and 5 and the pressure chambers (not visible) disposed on the opposite side of the upper can be inflated with a pressure medium frame a gas bottle 6 disposed in the sole 2 and connected via pressure medium connection 10 to extension sensor 7, as soon as an extension sensor 7 detects such a severe extension of the upper 1 that a collateral fibular ligament injury to the user of the show can be expected. The subsequent inflation of the pressure chambers 3, 4, 5 makes the shoe so rigid that hyperextension of the collateral fibular ligaments is precluded.

Figure 2:
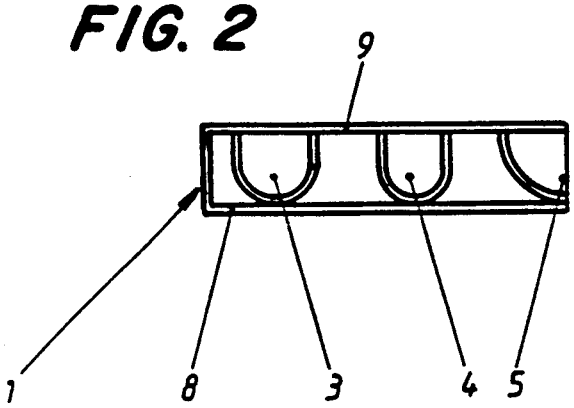
FIG. 2 shows a horizontal cross-section through the upper of a shoe along line II—II in FIG. 1.
Figure 3:
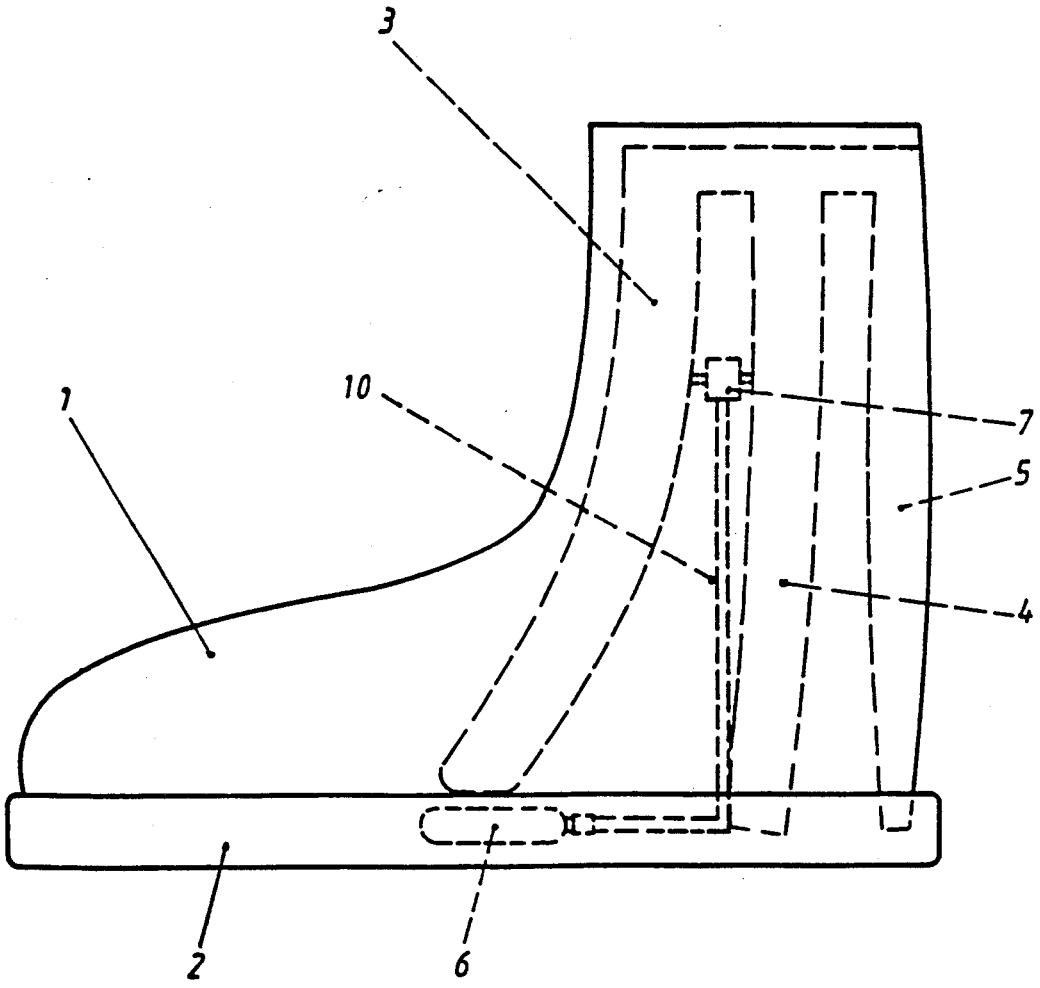
FIG. 3 is a side view of another preferred embodiment of a shoe according to the invention.

The cross-sectional depiction in FIG. 2 permits one to see the individual pressure chambers 3, 4, 5 in cross-section. In the noninflated state the pressure chambers 3, 4, 5 are flat, so that an outer wall 8 and an inner wall 9 of the upper 1 lie against one another and the shoe thus permits good mobility of the foot.

I claim:

1. Device to prevent collateral fibular ligament injuries, said device comprising:

means for restricting movement to prevent twisting or spraining of the foot, said movement restricting means including at least one inflatable pressure chamber provided in an upper of a shoe that extends to a point before a sole of the shoe or all the way into the sole; and means for actuating said movement restricting means upon detection of hyperextension of the foot, said means including an extension sensor, an accumulator in the form of a pressurized gas bottle, and a pressure medium connection extending between said gas bottle and said extension sensor and between said extension sensor and said at least one pressure chamber, wherein, when said extension sensor detects hyperextension of the foot, said extension sensor opens said pressure medium connection so that said at least one pressure chamber is pressurized.

2. Device according to claim 1, wherein the gas bottle is disposed in the sole of the shoe.

3. Device according to claim 1, wherein three said pressure chambers are used.

* * * * *